United States Patent [19]

Taruntaev

[11] 4,391,121

[45] Jul. 5, 1983

[54] ORBITAL TOOL ASSEMBLY FOR FORMING RIVET HEADS

[75] Inventor: V. Taruntaev, Davison, Mich.

[73] Assignee: T. A. Systems, Inc., Troy, Mich.

[21] Appl. No.: 263,380

[22] Filed: May 13, 1981

[51] Int. Cl.[3] ..... B21J 7/20

[52] U.S. Cl. ..... 72/406; 72/67; 72/112; 173/52

[58] Field of Search ..... 72/406, 429, 67, 112, 72/125, 432, 465; 173/101, 52

[56] References Cited

U.S. PATENT DOCUMENTS

| | | | |
|---|---|---|---|
| 1,612,338 | 12/1926 | Wilson et al. | 173/52 |
| 3,800,579 | 4/1974 | Breiter | 72/67 |
| 3,899,909 | 8/1975 | Taruntaev | 72/406 |

*Primary Examiner*—Francis S. Husar
*Assistant Examiner*—David B. Jones
*Attorney, Agent, or Firm*—Cullen, Sloman, Cantor, Grauer, Scott, & Rutherford

[57] ABSTRACT

An orbital tool assembly for forming rivet heads has a housing attached to a driven member rotatable upon a first axis, the housing having a bore along a second axis at an acute angle to the first axis. A head having an axis coincident with the second axis and including a fluid pressure chamber is retained within the housing with bearings interposed. A coaxial driver on the head has a plurality of bores parallel to the second axis in communication with the pressure chamber, and mounts a reciprocal peening tool holder in each bore, supporting an axial peening tool. An anti-rotation arm at one end extends at right angles to the driver and is secured thereto with its other end engaging a bracket, the arm being free for rocking movements in a plane passing through the first and second axes. Rotation of the head oscillates the peening tools in the rocking plane, the peening tools being in operative engagement with unheaded rivets.

27 Claims, 5 Drawing Figures

ORBITAL TOOL ASSEMBLY FOR FORMING RIVET HEADS

BACKGROUND OF THE INVENTION

Heretofore there has long existed the problem of forming heads upon one or a plurality of rivets projecting through a pair of parts upon a support to be secured together by a tool or tools adapted to operatively engage the unheaded rivets and for automatically peening the heads thereof in a continuous operation.

The Prior Art

Examples of prior art construction for forming heads on rivets are found in the following United States patents:

3,440,840, Apr. 29, 1969, K. Friedrich;
3,595,324, July 27, 1971, C. Guild;
3,620,060, Nov. 16, 1971, P. Ramseier;
3,653,243, Apr. 4, 1972, P. Ramseier;
3,675,461, July 11, 1972, C. Berndt;
3,703,823, Nov. 28, 1972, G. Wilson;
3,762,199, Oct. 2, 1973, S. Yoshikawa;
3,779,059, Dec. 18, 1973, G. Mink;
3,800,579, Apr. 2, 1974, F Breiter; and
3,899,909, Aug. 19, 1975, V. Taruntaev.

SUMMARY OF THE INVENTION

An important feature of the present invention is the provision of an orbital tool assembly for forming rivet heads which includes a plurality of peening tools reciprocally mounted upon a non-rotative driver so that upon a rotative drive of the housing for the tool, the driver and the depending peening tools are reciprocally rocked as a unit in a plane in operative registry with unheaded rivets for forming heads thereon.

A further feature incorporates a power driven housing rotatable upon a first axis and having a bore therein extending along a second axis inclined at an acute angle to the first axis and the mounting of an elongated equalizing head having a longitudinal axis coincident with the second axis and nested and retained within the housing with suitable bearings interposed. The head supports a driver coaxially thereof which has a plurality of longitudinal bores parallel to the second axis which are in communication with the pressure chamber within the head, wherein a plurality of longitudinally reciprocal peening tool holders and/or mounting peening tools are movably mounted in the driver bores and normally biased outwardly of the driver for operative working engagement with the unformed rivet heads.

A still further feature includes means for retaining the driver against rotation wherein on continuous rotation of the housing the head, the driver and peening tools are oscillated in a plane over the ends of the rivets forming heads thereon.

Another feature incorporates an anti-rotation arm which is secured to the driver for retaining the driver against rotation with respect to the rotatable housing journalled thereon, with the housing rotating on a first axis and wherein the head being mounted within the housing upon a second axis at an acute angle to the first axis. The continuous rotation of the housing causes a rocking action of the head within a single plane passing through the axes of the housing and head, the anti-rotation arm being free for guided movements in the rocking plane.

Other features will be seen from the following specification and claims in conjunction with the appended drawings.

THE DRAWINGS

It will be understood that the above drawings illustrate merely preferred embodiments of the invention, and that other embodiments are contemplated within the scope of the claims hereafter set forth.

DETAILED DESCRIPTION OF A PREFERRED EMBODIMENT OF THE PRESENT INVENTION

Figures 1, 2:
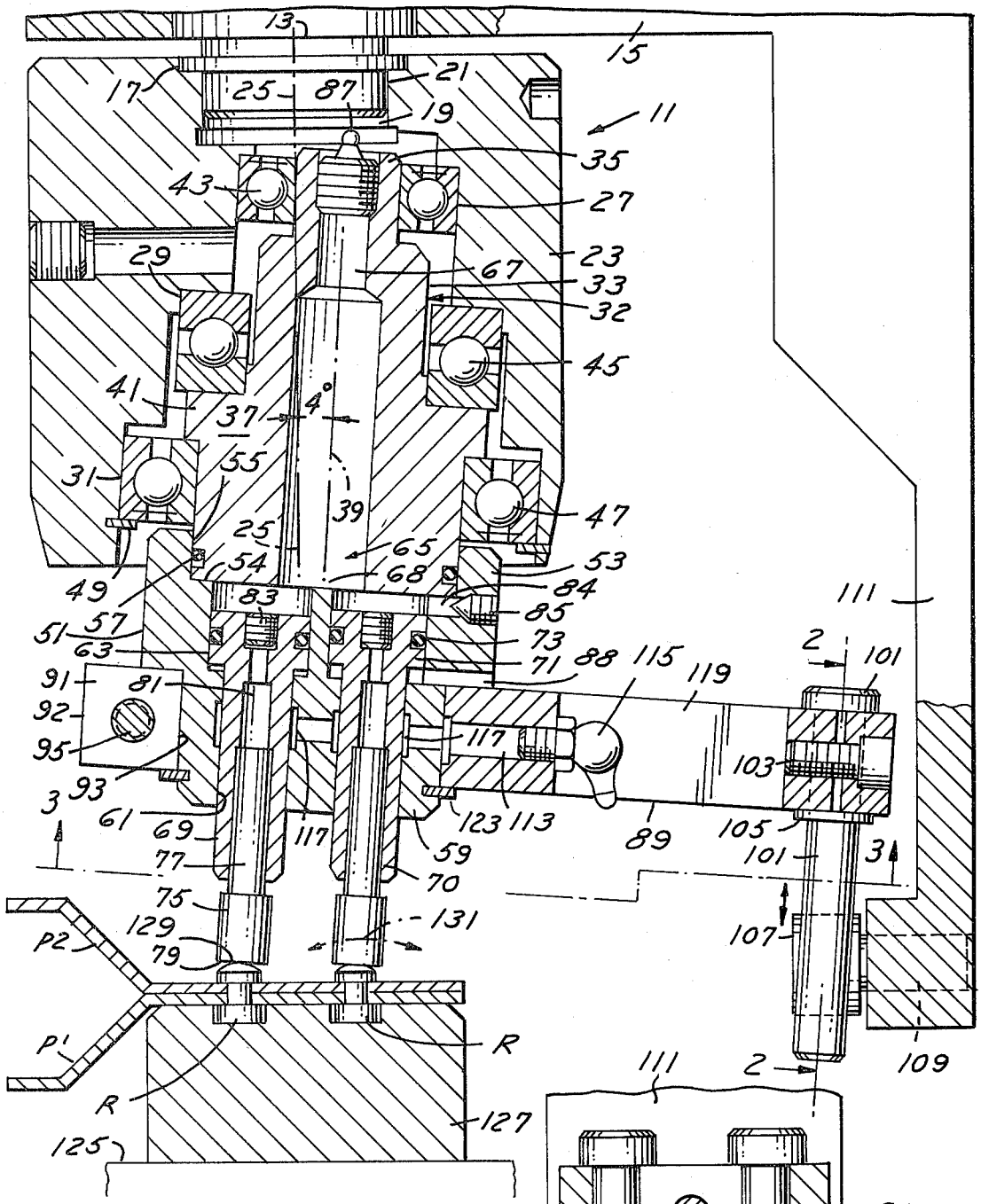
FIG. 1 is a vertical section of an orbital tool assembly in accordance with the present invention adapted for attachment to the driven member of a power tool fragmentarily shown.
FIG. 2 is a fragmentary section taken in the direction of arrows 2—2 of FIG. 1.

Referring to the drawings, FIGS. 1 through 4, the present orbital tool assembly generally indicated at 11, FIG. 1 is adapted for forming rivet heads 129, the rivets R projecting through a pair of parts P1, P2 upon support block 127 mounted upon a suitable support 125 fragmentarily shown.

Axial drive shaft 13, fragmentarily shown, depends from a power tool 15, fragmentarily shown, upon any suitable support such as support 125, FIG. 1 and includes an annular stop flange 17. The flange 17 bears against a rotatable housing 23 and is connected thereto as by threads 21 or by a press fit for a rotation in unison upon a first axis 25. The housing 23, cylindrical in form, having axis of rotation 25, has formed therein counterbores 27,29 and 31 which are spaced along a second axis 39 inclined at an acute angle, four (4) degrees for illustration, with respect to the first axis of rotation 25.

Elongated equalizing head 32 has a spindle 33 and upon one end thereof shank 35 and upon its opposite end head portion 37 all arranged upon second axis 39 at an acute angle to the first axis 25. This angle may range between 3 and 8 degrees approximately. The head portion 37 defines with spindle 33 an intermediate radial and annular shoulder 41.

A radial bearing 43 bears against an internal shoulder within housing 23 and cooperatively receives shank 35. Thrust bearing 45 bears against an internal shoulder within housing 23 and cooperatively receives spindle 33 in engagement with one side of shoulder 41. Thrust bearing 47 is nested within the housing 23 and supportably bears against shoulder 41 of the equalizing head 32 and is retained within the housing 23 by snap ring 49.

The plurality of bearings 43, 45 and 47 are thus interposed between the equalizing head 32 and the housing 23 which is rotatable with respect to the head 32 upon the first axis 25 shown in FIG. 1.

The cylindrical driver 51 at one end has an annular flange 53 defining the internal stop shoulder 54 which is coaxially mounted over the depending end of head portion 37 with a suitable O-ring seal 57 interposed. Driver 51 has a depending annular shank 59 coaxial with equalizing head 32 and arranged upon the second axis 39, FIG. 1.

The driver 51 has formed therein a plurality of longitudinal parallel bores 61 which are parallel to the second axis 39 and terminate at their inner ends in the counterbores 63 defining cylinders within the driver 51. Equalizing head 32 has a central longitudinal bore defining pressure chamber 65, adapted to receive pressurized grease or oil as at 67. The chamber 65 is closed at one end by the pressure fitting 87 and is opened at its other end as at 68 for communication with the driver counterbores or cylinders 63.

A longitudinally reciprocal peening tool holder 69 is reciprocally positioned within the respective driver bores 61 and at its inner end terminates in the piston 71 mounting an O-ring seal 73 movable within the respective counterbore or cylinder 63. Each of the peening tool holders 69 has a longitudinal bore 70 within which is axially projected the respective shank 77 of the peening tool 75 adapted for reciprocal movements with peening tool holder 69.

The peening tools 75 are arranged upon longitudinal axes which are parallel to the second axis 39 which coincides with the longitudinal axis of the equalizing head 32 and the coaxial driver 51 connected thereto. The peening tools 75 have at their ends the transverse work surfaces 79 adapted for continuous operative compressive engagement with the respective shanks of the rivets R forming the rivet heads, 129 FIG. 1.

In the illustrative embodiment, elongated magnets 81 are snugly nested within bores 69 and are in operative retaining registry with the respective shank 77 of the peening tools 75 for further securing the tools 75 within holders 69. The respective longitudinal bores 70 within each of the holders 69 at their piston ends have axial cone point plugs 83 closing off the bores 70 for maintaining the pressurized grease or oil within the respective cylinders defined by the counterbores 63 upon one side of the respective pistons 71.

A radial passage 84 is formed within driver 51 and is normally sealed closed by the cone point bleed plug 85, FIG. 1. Breather chamber 88 extends radially into portions of the driver 51 in communication with the counterbores 63 upon the far side of the respective pistons 71.

Figure 3:
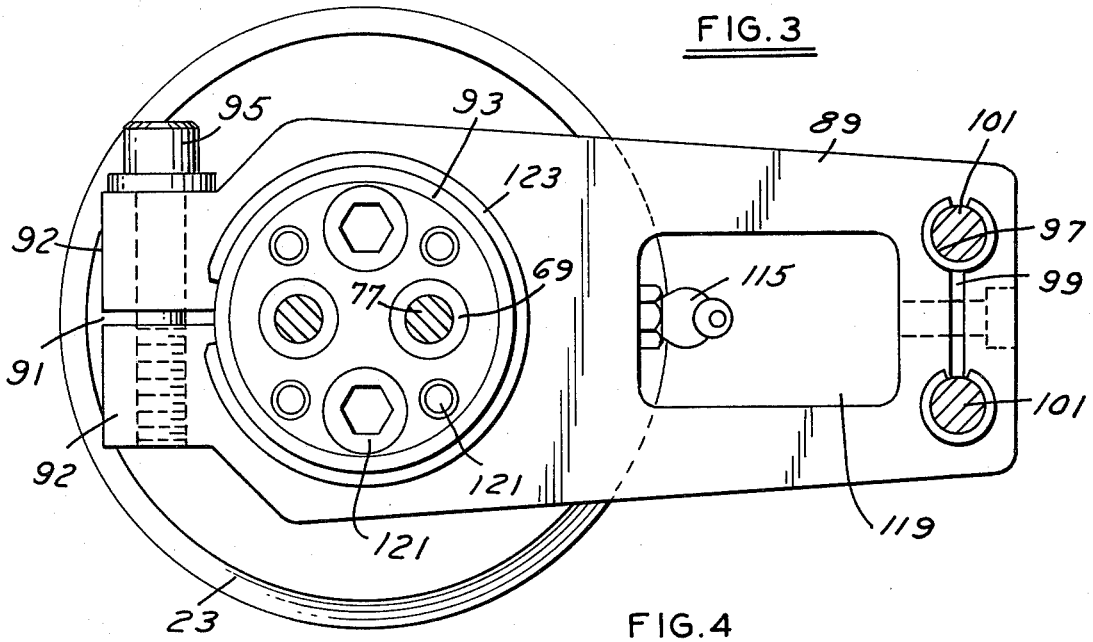
FIG. 3 is a bottom plan view, partly sectioned, taken in the direction of arrows 3—3 of FIG. 1.

Anti-rotation arm 89 at one end has a transverse bore 93 therethrough terminating in the outwardly opening slot 91, FIG. 3, defines a pair of spaced anchors 92 which are drawn together by the transverse fastener 95 for securing the anti-rotation arm upon the end of the driver 51. Driver shank 59 projects through bore 93 and is retained against relative longitudinal movement with respect to the anti-rotation arm by the snap ring 123, FIG. 1.

Upon the opposite end of the anti-rotation arm 89 are a pair of laterally spaced bores 97, FIG. 3, with a communicating transverse slot 99. A pair of upright headed stop pins 101 project through the respective bores 97 and are secured therein by the central screw 103 and retained against longitudinal movement relative to arm 89 by snap ring 105.

Stop roll 107 is interposed between stop pins 101 as in FIGS. 1 and 2, and has a shank 109 which is threaded into one end of bracket 111 which depends from the tool 15, fragmentarily shown in FIG. 1. An elongated grease passage 113 is formed with the anti-rotation arm 89 intermediate its ends and at one end terminates in the pressure fitting 115 adapted to receive grease under pressure. Annular lubricating chambers 117 formed within the driver 51 outwardly of and concentric to its bores 61 intermediate the ends of the holders 69 and are in communication with the grease passage 113 for providing sufficient lubrication for the continuous reciprocal movements of the peening tool holders 69.

A portion of the anti-rotation arm 89 adjacent one end has a transverse aperture 119, FIG. 3 providing access to grease fitting 115.

In the illustrative embodiment upon a suitable support 125 there is shown, for illustration, a support block 127 recessed to receive the heads of a pair of rivets R which initially are unheaded and which extend through corresponding apertures within a pair of parts P1, P2 which bear upon support block 127. The rivets R initially unformed are operatively engaged by the peening tools 75 at their work surfaces 79 and upon oscillating movements of the peening tools within a single plane passing through the axes 25 and 39, cause the rivets R to be peened over and headed at 129, FIG. 1.

Since the housing 23 is rotating upon the first axis 25, at an acute angle with respect to the compensating head axis 39, and since the driver 51, is restrained against rotary movement by the arm 89, continuous rotation of housing 23 will cause a rocking action of the driver 51, including the peening tools 75, in a plane which passes through axes 25 and 39. This is shown by the arcuate peen path 131, FIG. 1.

Figure 4:
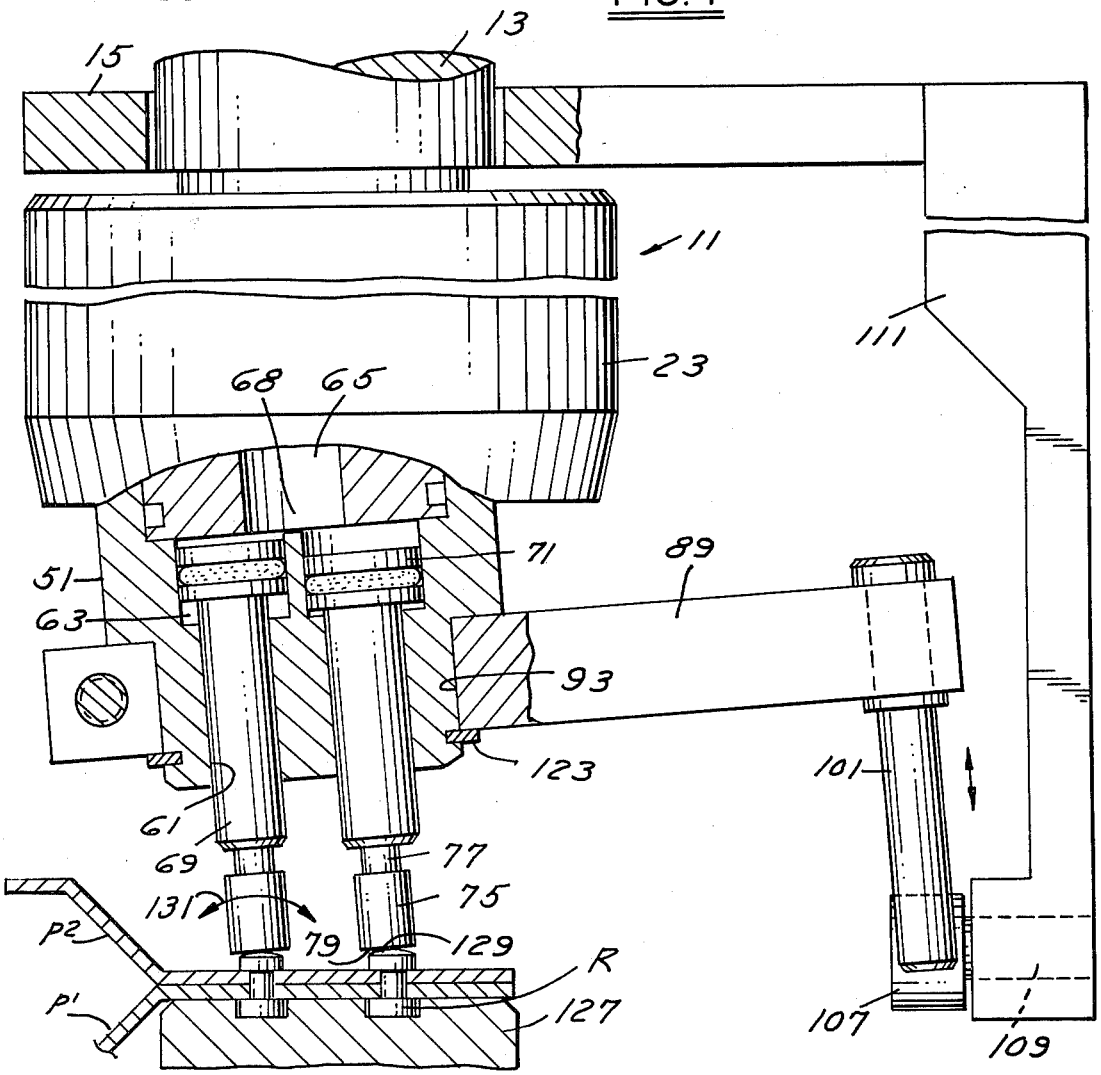
FIG. 4 is a fragmentary partly sectioned side elevational view of the tool assembly shown in FIG. 1 illustrating the head as oscillated in a single plane from the position shown in FIG. 1.

Since the equalizing head 32 is constrained against rotation, but is arranged upon the second axis 39 with respect to the axis of rotation 25 of the housing 23, upon such continuous rotation of housing 23, the head 32 and its corresponding axis 39 will translate in a single plane from one extreme position to one side of axis 25, FIG. 1, to the other extreme position upon the opposite side of axis 25, FIG. 4.

Continuous rotation of housing 23 oscillates the head 32 and the peening tools 75 in the same plane over the ends of the rivets R forming heads 129 thereon. The equalizing head 32, during rotation of the housing 23 is rocking in a plane defined by axes 25 and 39. Accordingly, the respective pins 101 upon the anti-rotation arm 89, being in operative engagement with the roll 107, nevertheless are adapted for upward movements with respect to roll 107, as shown in FIG. 4, but in said single plane.

Since the respective cylinders 63 at the ends thereof defined by the pistons 71 are in communication at all times with pressure chamber 65 as at 68, the pressure within the respective cylinders is at all times operating against the respective pistons 71. This pressure normally biases pistons 71 and the connected peening tools 75 continuously into operative engagement with rivets R during the period that the driver 51 is oscillated in the single plane defined by axes 25 and 39.

Since the housing 23 is continuously rotating, the angular axis 39 is actually translating with respect to the stationary axis 25 so that in effect there is a rocking action of the driver 51 and the corresponding peening tools 75 as shown at 131 with respect to the rivets R. Therefore, since there is a closed fluid or hydraulic circuit between the pressure chamber 65 and the respective cylinders 63 upon one side of the pistons 71, if one of the pistons 71 as shown at at the right hand side in FIG. 1 is retracted due to the position of the driver in FIG. 1, the additional fluid is transferred to the second cylinder continuously biasing the adjacent peening tool 75 downwardly so as to at all times remain in contact with the other rivet R. Therefore, with the pressure system employed during the oscillating movements of the driver 51, the respective peening tools are at all times maintained in contact with the respective rivets R with the rocking occuring in a single plane which includes axes 25 and 39.

MODIFICATION

Figure 5:
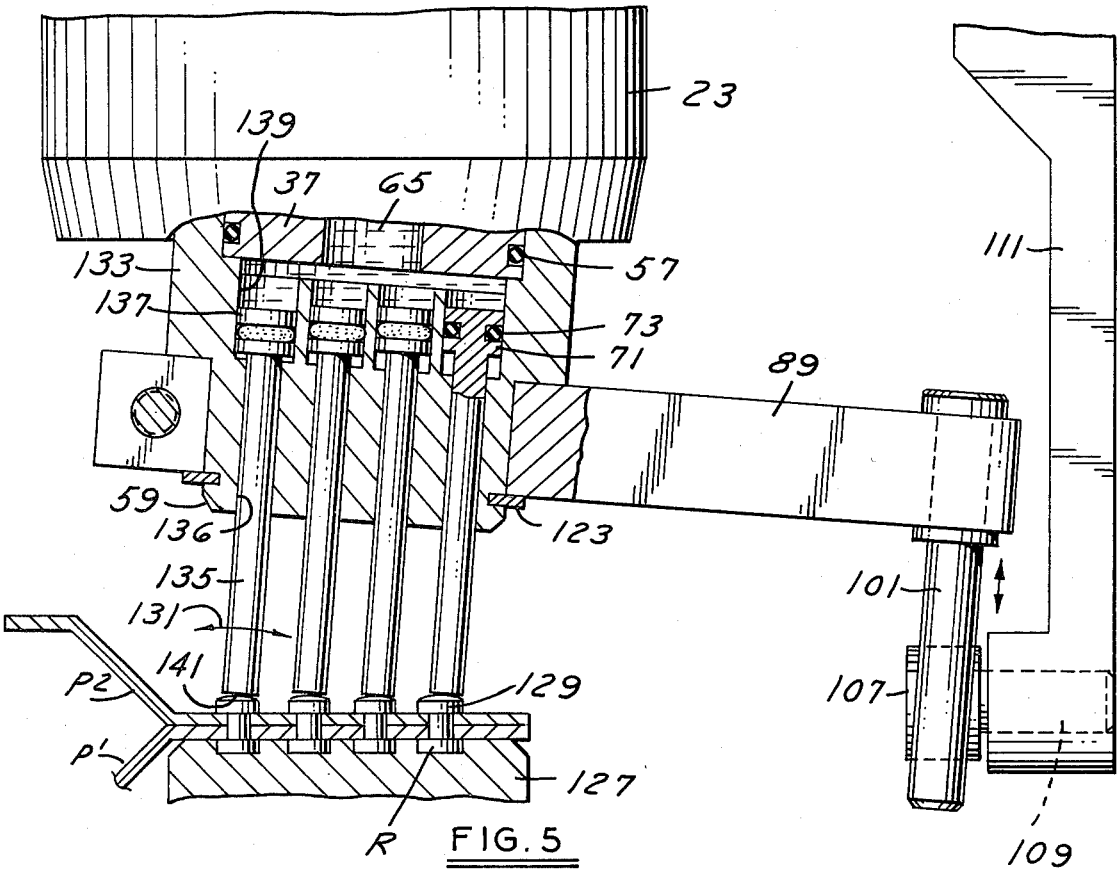
FIG. 5 is a side elevational partly sectioned view of another embodiment of the present invention, similar in certain respects to FIG. 1, illustrating the oscillating driver as mounting a series of peening tools directly upon the driver thereby omitting the peening tool holders of FIG. 1.

A modification is shown in FIG. 5 which functions the same as above described except that herein, the driver 133 is modified to eliminate the bores 61 adapted to receive the peening holders 69 in FIG. 1. The driver 133 merely has the plurality of parallel bores 136 adapted to receive the parallel spaced coplanar peening tools 135. Each of the peening tools 135 at its inner end has an enlarged head or piston 137 movable within the corresponding counterbore 139 formed within the driver 133 and in communication with pressure chamber 65.

The work engaging surfaces 141 of the respective peening tools 135 are in direct engagement with the rivets R upon the support block 127 schematically shown in FIG. 5.

The term fluid as used herein means an incompressible or semicompressible fluid such as heavy grease, hydraulic oil, water, waxes, glycol, mercury, etc. It does not include any gas.

It should be appreciated that the work engaging surfaces 79 and 141 on the peening tools 75 and 135 respectively may have various configurations such as a flat end as illustrated, a conical end or a crowned end.

Having described my invention, reference should now be had to the following claims.

I claim:

1. An orbital tool assembly for forming rivet heads comprising a housing adapted for an attachment to a driven member rotatable upon a first axis;

said housing having a bore extending along a second axis inclined at an acute angle to said first axis;

an elongated equalizing head having a longitudinal axis coincident with said second axis nested and retained within said housing;

bearing means interposed between said head and housing for journalling said housing for rotation about said first axis relative to said head;

said head having an axial bore defining a fluid pressure chamber open at one end;

a cylindrical driver coaxial with and mounted upon said head projecting from said housing and having a plurality of longitudinal bores parallel to said second axis and communicating with said pressure chamber;

a longitudinally reciprocal peening tool holder having an elongated bore movably mounted in each of said driver bores;

each holder having a piston movable in said driver head bore and normally biased outward by pressurized fluid filling said head and driver bores on one side of said piston;

an elongated peening tool mounted within each peening tool holder, at its outer end having a transverse rivet working surface, adapted for registry and operative engagement with an unheaded rivet projecting through a pair of parts upon a support to be secured together;

an elongated anti-rotation arm extending at right angles to said driver and at one end mounted upon and secured thereto;

and a bracket means upon a support retainingly engaging said arm at its opposite end against rotation, said arm being free for rocking movements in a plane passing through said axes;

continuous rotation of said housing oscillating said head and peening tools in said plane over the ends of said rivets forming heads thereon.

2. The tool assembly of claim 1, said driven member forming part of a power tool;

said bracket means support being connected to said power tool and depending therefrom.

3. The tool assembly of claim 1, the angle between said first and second axes being in the range of 3 to 8 degrees.

4. The tool assembly of claim 1, the angle between said first and second axes being 4 degrees approximately.

5. The tool assembly of claim 1, said head including a central spindle, a coaxial shank at one end thereof and a coaxial head portion at its other end, said spindle and head portion defining an annular radial support shoulder therebetween;

said bearing means including longitudinally spaced radial and thrust bearings interposed between said housing and said spindle, shank and head member respectively, and retained within said housing;

one of said bearings retainingly and supportably engaging said shoulder.

6. The tool assembly of claim 1, a pressure fitting within and upon said head communicating with said pressure chamber adapted for connection to a source of fluid or oil under pressure for filing said pressure chamber and end portions of said driver bores adjacent said pistons.

7. The tool assembly of claim 1, said driver bores having a counter bore at one end defining a cylinder communicating with said pressure chamber and receiving said pistons respectively.

8. The tool assembly of claim 7, said peening tool holders reciprocating alternately within said driver bores;

displaced pressure fluid from one cylinder transferring to the other cylinder, whereby the peening tools are continuously biased against said rivets during oscillations of said head.

9. The tool assembly of claim 1, said head and its axis oscillating in said plane from one extreme position on one side of said first axis to the opposite extreme position upon the other side of said first axis, said peening tool holders reciprocating alternately within said driver bores, displaced pressure fluid from one cylinder transferring to the other cylinder, whereby said peening tools are continuously biased against said rivets during oscillations of said head.

10. The tool assembly of claim 1, there being communicating annular grooves in said driver outwardly of each driver bore, there being an elongated passage in said anti-rotation arm having an outlet and at its inner end communicating with said annular grooves;

and a pressure fitting on said arm within said outlet adapted for connection to a source of fluid or oil under pressure for filling said annular grooves and lubricating said peening tool holders.

11. The tool assembly of claim 1, the mounting of said anti-rotation arm including a transverse bore and an end slot within said arm defining a pair of spaced anchors;

said bore snugly receiving said driver;

and a fastener extending between said anchors for frictionally securing said arm upon said driver.

12. The tool assembly of claim 11, a snap ring nested within an annular recess in said driver and supportably engageable with said anti-rotation arm.

13. The tool assembly of claim 1, said bracket means including a roll on said support underlying the other end of said anti-rotation arm;

and a pair of laterally spaced parallel pins secured to and depending from said other end of said arm guidably bearing against said opposite sides of said roll;

said pins adapted for longitudinal movements relative to said roll during oscillations of said head.

14. The tool assembly of claim 1, a magnet secured within each peening tool holder and in engaging securing registry with a peening tool therein.

15. The tool assembly of claim 1, said housing having a radial passage at one end communicating with its bore adapted to receive a lubricant for said bearings;

and a removable plug in said housing nested within the other end of said radial passage.

16. An orbital tool assembly for forming rivet heads comprising a housing adapted for an attachment to a driven member rotatable upon a first axis;

said housing having a bore extending along a second axis inclined at an acute angle to said first axis;

an elongated equalizing head having a longitudinal axis coincident with said second axis nested and retained within said housing;

bearing means interposed between said head and housing for journalling said housing for rotation about said first axis relative to said head;

said head having an axial bore defining a fluid pressure chamber open at one end;

a cylindrical driver coaxial with and mounted upon said head projecting from said housing and having a plurality of longitudinal bores parallel to said second axis and communicating with said pressure chamber;

an elongated peening tool mounted within each driver bore at its outer end having a transverse rivet working surface adapted for registry and operative engagement with an unheaded rivet projecting through a pair of parts upon a support to be secured together;

each peening tool at its inner end having a piston movable in said driver head bore and normally biased outward by pressurized fluid filling said head and driver bores on one side of said piston;

an elongated anti-rotation arm extending at right angles to said driver and at one end mounted upon said secured thereto;

and a bracket means upon a support retainingly engaging said arm at its opposite end against rotation, said arm being free for rocking movements in a plane passing through said axes;

continuous rotation of said housing oscillating said head and peening tools in said plane over the ends of said rivets forming heads thereon.

17. The tool assembly of claim 16, said driven member forming part of a power tool;

said bracket means support being connected to said power tool and depending therefrom.

18. The tool assembly of claim 16, the angle between said first and second axes being in the range of 3 to 8 degrees.

19. The tool assembly of claim 16, the angle between said first and second axes being 4 degrees approximately.

20. The tool assembly of claim 16, said head including a central spindle, a coaxial shank at one end thereof and a coaxial head portion at its other end, said spindle and head portion defining an annular radial support shoulder therebetween;

said bearing means including longitudinally spaced radial and thrust bearings interposed between said housing and said spindle, shank and head member respectively, and retained within said housing;

one of said bearings retainingly and supportably engaging said shoulder.

21. The tool assembly of claim 16, a pressure fitting within and upon said head communicating with said pressure chamber adapted for connection to a source of fluid or oil under pressure for filing said pressure chamber and end portions of said driver bores adjacent said pistons.

22. The tool assembly of claim 16, said driver bores having a counter bore at one end defining a cylinder communicating with said pressure chamber and receiving said pistons respectively.

23. The tool assembly of claim 22, said peening tools reciprocating alternately within said driver bores;

displaced pressure fluid from one cylinder transferring to the other cylinder, whereby said peening tools are continuously biased against said rivets during oscillations of said head.

24. The tool assembly of claim 16, said head and its axis oscillating in said plane from one extreme position on one side of said first axis to the opposite extreme position upon the other side of said first axis, said peening tools reciprocating alternately within said driver bores, displaced pressure fluid from one cylinder transferring to the other cylinder, whereby said peening tools are continuously biased against said rivets during oscillations of said head.

25. The tool assembly of claim 16, the mounting of said anti-rotation arm including a transverse bore and an end slot within said arm defining a pair of spaced anchors;

said bore snugly receiving said driver;

and a fastener extending between said anchors for frictionally securing said arm upon said driver.

26. The tool assembly of claim 25, a snap ring nested within an annular recess in said driver and supportably engageable with said anti-rotation arm.

27. The tool assembly of claim 16, said bracket means including a roll on said support underlying the other end of said anti-rotation arm;

and a pair of laterally spaced parallel pins secured to and depending from said other end of said arm guidably bearing against said opposite sides of said roll;

said pins adapted for longitudinal movements relative to said roll during oscillations of said head.

* * * * *